US010041276B2

(12) United States Patent
Schoch et al.

(10) Patent No.: US 10,041,276 B2
(45) Date of Patent: Aug. 7, 2018

(54) VEHICLE LOCKING APPARATUS FOR A VEHICLE USING A COUPLING DEVICE

(71) Applicant: AUDI AG, Ingolstadt (DE)

(72) Inventors: Marion Schoch, Neckarsulm (DE); Jean-Bernard Le Griffon, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 215 days.

(21) Appl. No.: 14/654,204

(22) PCT Filed: Dec. 20, 2013

(86) PCT No.: PCT/EP2013/003881

§ 371 (c)(1),
(2) Date: Jun. 19, 2015

(87) PCT Pub. No.: WO2014/095077

PCT Pub. Date: Jun. 26, 2014

(65) Prior Publication Data

US 2015/0322697 A1 Nov. 12, 2015

(30) Foreign Application Priority Data

Dec. 21, 2012 (DE) ..... 10 2012 025 336

(51) Int. Cl.
*E05C 17/44* (2006.01)
*E05B 63/12* (2006.01)
(Continued)

(52) U.S. Cl.
CPC ..... *E05B 63/12* (2013.01); *E05B 63/126* (2013.01); *E05B 63/14* (2013.01); *E05B 79/04* (2013.01);
(Continued)

(58) Field of Classification Search
CPC ..... Y10T 292/71; Y10T 292/696; Y10T 292/699; Y10S 292/51; E05C 17/54;
(Continued)

(56) References Cited

U.S. PATENT DOCUMENTS 1,081,927 A * 12/1913 Forsyte ..... B61D 13/00 105/333
1,366,706 A 1/1921 Schoell
(Continued)

FOREIGN PATENT DOCUMENTS

CN 101094785 12/2007
CN 101978127 2/2011
(Continued)

OTHER PUBLICATIONS

International Search Report issued by the European Patent Office in International Application PCT/EP2013/003881.
(Continued)

*Primary Examiner* — Carlos Lugo
(74) *Attorney, Agent, or Firm* — Henry M. Feieresen LLC

(57) ABSTRACT

A vehicle locking apparatus for a vehicle using a coupling device for the separable connection of a vehicle door to a vehicle structure part, includes a first coupling element with two locking wedges mounted so as to be displaceable parallel to one another and having wedge faces. At least one of the locking wedges is formed with a locking nose on the wedge-side end face, and a second coupling element interacts with the first coupling element. The second coupling has two retaining jaws receiving the first coupling element therebetween with wedge grooves having wedge faces. The locking wedges are pushed via a driving device into the wedge grooves by separation of the wedge faces apart from
(Continued)

one other and the locking nose is thereby received in a locking opening arranged in a wedge groove of a retaining jaw.

6 Claims, 3 Drawing Sheets

(51) Int. Cl.

| | |
|---|---|
| ***E05B 85/04*** | (2014.01) |
| ***E05B 63/14*** | (2006.01) |
| ***E05B 79/04*** | (2014.01) |
| ***E05B 81/00*** | (2014.01) |
| ***E05B 85/22*** | (2014.01) |
| *E05C 17/54* | (2006.01) |

(52) U.S. Cl.
CPC ..... *E05B 81/00* (2013.01); *E05B 85/04* (2013.01); *E05B 85/22* (2013.01); *E05C 17/54* (2013.01); *Y10S 292/51* (2013.01); *Y10T 292/0962* (2015.04)

(58) Field of Classification Search
CPC ..... E05B 63/12; E05B 63/14; E05B 63/126; E05B 79/04
USPC ..... 292/3–20, 32, 33, 37, 42, 342, 343; 296/146.6
See application file for complete search history.

(56) References Cited

U.S. PATENT DOCUMENTS

| | | | | | |
|---|---|---|---|---|---|
| 1,964,157 | A | | 3/1925 | Holtzman | |
| 1,757,021 | A | * | 5/1930 | Remondino | E05B 83/247 292/175 |
| 1,965,672 | A | * | 7/1934 | Seitz | E05F 5/025 16/85 |
| 2,344,826 | A | * | 3/1944 | Le Gresley | E05B 77/54 180/271 |
| 2,489,957 | A | * | 11/1949 | Davis | E05C 9/046 292/181 |
| 2,869,952 | A | * | 1/1959 | Saunders | E05C 19/02 109/63.5 |
| 2,973,984 | A | * | 3/1961 | Burke | E05B 77/46 292/182 |
| 3,583,736 | A | * | 6/1971 | Willimzik | E05C 7/06 292/16 |
| 3,583,737 | A | * | 6/1971 | Tutikawa | E05C 19/02 292/16 |
| 3,610,668 | A | * | 10/1971 | Tixier | E05B 85/24 292/341.12 |
| 4,192,039 | A | * | 3/1980 | Haberle | B60J 5/101 16/86 B |
| 4,940,282 | A | * | 7/1990 | Townsend | B62D 25/20 296/155 |
| 5,033,236 | A | * | 7/1991 | Szerdahelyi | B60J 5/0416 280/730.2 |
| 5,224,752 | A | * | 7/1993 | Marshall | B60J 5/0426 292/144 |
| 5,715,712 | A | * | 2/1998 | West | B60R 25/24 292/144 |
| 5,806,917 | A | * | 9/1998 | Townsend | B60J 5/0426 296/146.1 |
| 5,992,927 | A | * | 11/1999 | Scroggie | B60J 5/00 16/85 |
| 6,196,619 | B1 | * | 3/2001 | Townsend | B60J 5/0444 296/146.6 |
| 6,345,849 | B1 | * | 2/2002 | Yen | E05C 17/54 292/292 |
| 6,676,201 | B2 | * | 1/2004 | Im | B60J 5/101 16/82 |
| 7,258,381 | B2 | * | 8/2007 | Sturt | E05B 83/32 296/24.34 |
| 8,322,762 | B2 | * | 12/2012 | Watson | E05F 7/005 292/342 |
| 8,888,147 | B2 | * | 11/2014 | Blanck | B60R 7/04 292/34 |
| 9,428,092 | B2 | * | 8/2016 | Bosma | B60N 3/103 |
| 2011/0016934 | A1 | * | 1/2011 | Kowalczyk | E05B 47/0673 70/280 |
| 2012/0112474 | A1 | * | 5/2012 | Muramatsu | E05B 77/36 292/164 |
| 2015/0076840 | A1 | | 3/2015 | Schoch et al. | |
| 2015/0322697 | A1 | * | 11/2015 | Schoch | E05B 85/04 292/157 |
| 2015/0368939 | A1 | * | 12/2015 | Yamagata | E05B 85/02 292/200 |

FOREIGN PATENT DOCUMENTS

| | | | | |
|---|---|---|---|---|
| CN | 201794371 | | 4/2011 | |
| DE | 91 05 557 | U1 | 10/1991 | |
| DE | 103 15 565 | | 1/2006 | |
| DE | 10 2012 011 420 | | 12/2013 | |
| EP | 0811516 | A2 * | 12/1997 | B60J 5/0416 |
| FR | 2539794 | A1 * | 7/1984 | E05B 79/04 |
| FR | 2842852 | * | 7/2003 | |

OTHER PUBLICATIONS

Chinese Search Report dated Jun. 27, 2016 with respect to counterpart Chinese patent application 201380066371.3.
Translation of Chinese Search Report dated Jun. 27, 2016 with respect to counterpart Chinese patent application 201380066371.3.

* cited by examiner

VEHICLE LOCKING APPARATUS FOR A VEHICLE USING A COUPLING DEVICE

CROSS-REFERENCES TO RELATED APPLICATIONS

This application is the U.S. National Stage of International Application No. PCT/EP2013/003881, filed Dec. 20, 2013, which designated the United States and has been published as International Publication No. WO 2014/095077 and which claims the priority of German Patent Application, Serial No. 10 2012 025 336.2, filed Dec. 21, 2012, pursuant to 35 U.S.C. 119(a)-(d).

BACKGROUND OF THE INVENTION

The invention relates to a vehicle locking apparatus for a vehicle using a coupling device according to DE 10 2012 011 420 A1.

The coupling device of a motor vehicle known from DE 10 2012 011 420 A1 for the releasable connection of a pivotally supported vehicle body part component, in particular a vehicle door, a tailgate or front hood, with a structural part of the motor vehicle, includes a first coupling element with two locking wedges supported displaceable parallel relative to one another and a second coupling device interacting with the first coupling device, wherein in the coupled state of the coupling device, the first and second coupling element are coupled clearance-free via abutting wedge faces. The second coupling element is provided with two retaining jaws between which the first coupling element is received, with the retaining jaws having wedge faces with wedge grooves, such that the locking wedges are separated by a drive device causing their wedge faces to engage into and contacting the wedge grooves.

With this coupling device an effective form fit with the retaining jaws of the second coupling element is achieved with only two locking wedges, i.e., in all directions in a plane perpendicular to the locking wedges, both in longitudinal direction (x-direction) of the vehicle as well as in vertical direction (z-direction) of the vehicle. A strong frictional connection is achieved in the direction in which the locking wedge is driven into the wedge grooves of the retaining jaws.

Furthermore it is proposed for this coupling device known from DE 102012 011 420 A1 to provide at least one of the locking wedges with a locking nose at a side edge opposite the retaining jaw, which locking nose during locking moves into a corresponding locking opening within the wedge groove of the retaining jaw of the second coupling element that receives this locking wedge. This results in a complete form fit between both coupling elements also in transverse direction (y-direction) of the vehicle, i.e., in the direction towards the interior of the vehicle as well as towards the outside.

Finally, a conventional vehicle lock is provided for use of this known coupling device for a releasable coupling of a locked vehicle door with a B-pillar of the vehicle, wherein an interior and exterior door handle is provided to operate the vehicle lock as well as the coupling device. The use of both a coupling device as well as a conventional vehicle lock results in high material and installation costs.

SUMMARY OF THE INVENTION

It is therefore an object of the invention to provide a vehicle locking device that can be cost-effectively realized.

This object is achieved by a vehicle locking device including the features of the independent claim 1.

In the following, a coupling device for the releasable connection of a vehicle door with a structural element of the vehicle is used as vehicle locking device for a vehicle having the following features:

- a first coupling element with two locking wedges supported so as to be displaceable parallel to one another, wherein at least one of the locking wedges is provided with a locking nose, and
- a second coupling element interacting with the first coupling element, the second coupling element having two retaining jaws, between which the first coupling element is received, with the two retaining jaws having wedge faces which have wedge grooves, wherein the locking wedges are separated by a drive device causing their wedge faces to be pushed into the wedge grooves whereby the locking nose is received in a locking opening arranged in a retaining jaw.

In this vehicle locking device, the coupling device known from DE 10 2012 011 420 A1, besides its function of coupling the vehicle door with a body pillar, preferably the B-pillar, also functions as a vehicle lock so that a conventional vehicle lock is not required thus resulting in cost savings.

With this coupling of the locking wedges with the locking jaws realized with this vehicle locking function, not only a form closure in longitudinal direction (x-direction) and in vertical direction (z-direction) of the vehicle is achieved, but also in transverse direction of the vehicle (y-direction) due to a locking nose that is received in a locking opening during locking of the first and second coupling elements. This includes a form fit with regard to a rotation about axes in x-, y- and z-direction.

According to an embodiment of the invention, the locking nose is provided at a wedge-sided front side of the locking wedge and the corresponding locking opening is arranged within a wedge groove of the retaining jaw.

Alternatively, the locking nose is developed as locking wedge guiding element that is guided within a half keyway in z-direction that is formed by the locking wedge and the retaining jaw, and is driven into a locking port of the retaining jaw by shifting apart the locking wedge from a retracted position.

BRIEF DESCRIPTION OF THE DRAWING

In the following the invention is described in detail on the basis of an embodiment with reference to the enclosed Figures. It is shown in.

DETAILED DESCRIPTION OF PREFERRED EMBODIMENTS

Figure 1:
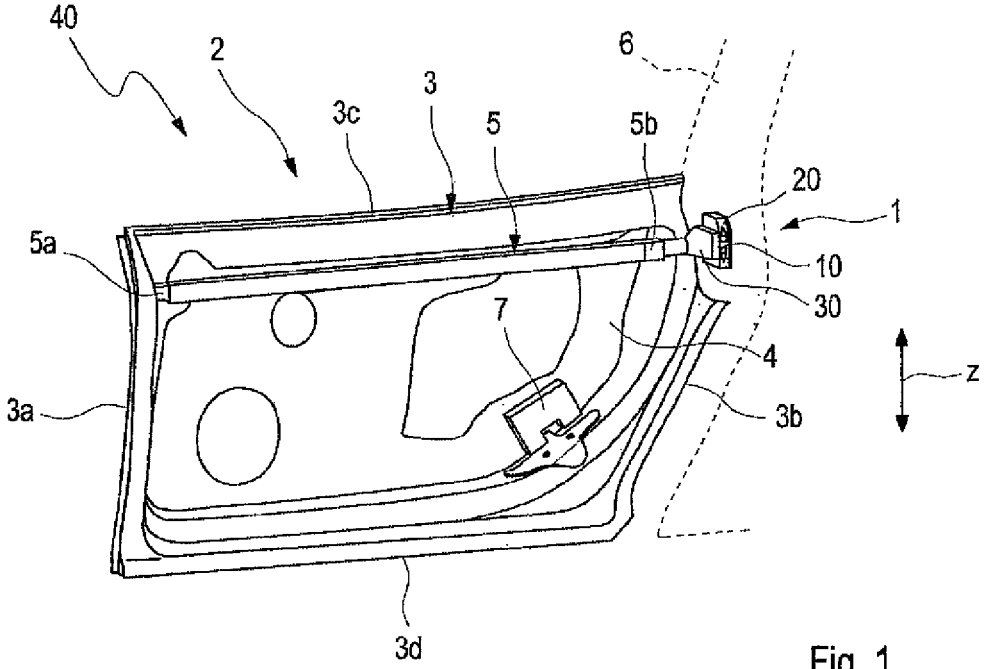
FIG. 1: a schematic and perspective view of a vehicle door that is connected to a B-pillar by a vehicle locking device according to the invention, FIG. 2 a schematic and perspective view of the first coupling element of the coupling device arranged on the vehicle door according to FIG. 1, which coupling device is used as a vehicle locking device.

FIG. 1 shows a vehicle door 2 of a vehicle 40, for example a motor vehicle, which is connectable to a B-pillar of the vehicle 40 via a vehicle locking device 1 so as to provide a locking function, thereby enabling a closing and locking of the vehicle 40.

This vehicle locking device 1 represents a coupling device known from DE 10 2012 011 420 and functions as a vehicle lock of the vehicle 40. This coupling device 1 includes a first coupling element 10 connected to the vehicle door 2 and a second coupling element 20 mounted to the B-pillar that are coupled to each other in order to create a releasable connection.

The vehicle door 2 is shown in a view from the outside and is constructed from a frame- and trough-like door frame 3, in the following referred to as outer interior door part, and a similarly trough-like inner interior door part 4 with through openings, that is connected on its border to an inner circumferential border of the outer interior door part 3 and serves as a module carrier for functional parts of the vehicle door 2.

Reference numeral 3*a* designates a hinge-side or stop-side front side of the vehicle door 2 or the outer interior door part 3, which front side is pivotally connected with an A-pillar of the motor, vehicle 40 via hinges (not shown). The opposite front side 3*b* is the lock-side front side of the vehicle door 2 or of the outer interior door part 3. Externally, the vehicle door 2 is completed by an outer panel (not shown) and internally by an interior door panel (not shown) so that in the area of the inner and outer interior door parts 3 and 4 a door box is formed for receiving functional parts and a window pane (not shown), wherein the window pane extends past the upper border 3*c* of the outer interior door part 3. The lower border 3*d* of the outer interior door part 3 is situated in the area of a sill of the vehicle 40.

The vehicle door 2 according to FIG. 1 has in the upper area of the outer interior door part 3 a door-stiffening-element 5 which connects both front sides 31 and 3*b* in longitudinal direction of the vehicle, i.e., in x-direction, and is for instance configured as U-section. The one end 5*a* of this door-stiffening-element 5 is connected to the upper region of the hinge-side front side 3*a* of the outer interior door part 3, whereas the other end 5*b* is connected to the lock-side front side 3*b* and at the same time ends with the first coupling element 10, which in its closed position is coupled with the second coupling element 20 that is arranged on the adjacent B-pillar 6, so that a load path is generated by the door-stiffening-element 5 via the first coupling element 10 and the second coupling element 20, thereby on the one hand increasing the stiffness of the vehicle door 2 and on the other hand improving the torsional stiffness of the vehicle body through the force-coupling via the two coupling elements 10 and 20 with the B-pillar 6.

In the following, the structure and mode of action of the coupling device 1 that serves the vehicle locking function is described with reference to FIGS. 2 to 4.

Figure 2:
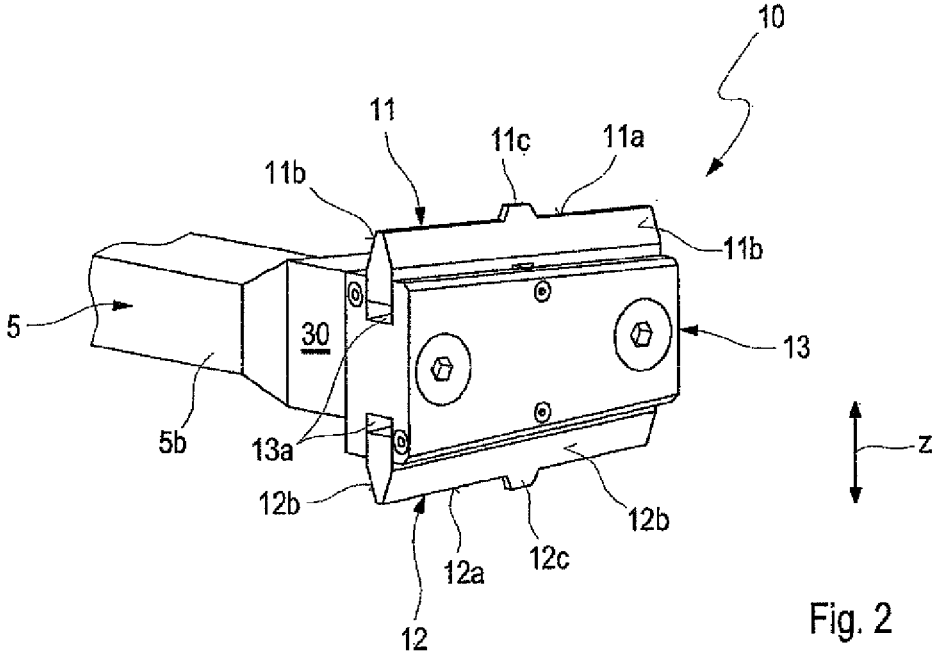

FIG. 2 shows the first coupling element 10 with a rectangular shaped locking wedge holder 13, having longitudinal sides on each of which a locking wedge 11 and 12 are supported in a respective wedge groove 13*a* of the locking wedge holder 13 so as to be displaceable in z-direction. The locking wedges 11 and 12 are each provided at their free front sides 11*a* and 12*a* with a symmetrical wedge-shaped cross section resulting in two respective wedge-shaped surfaces 11*b* and 12*b*.

Figure 3:
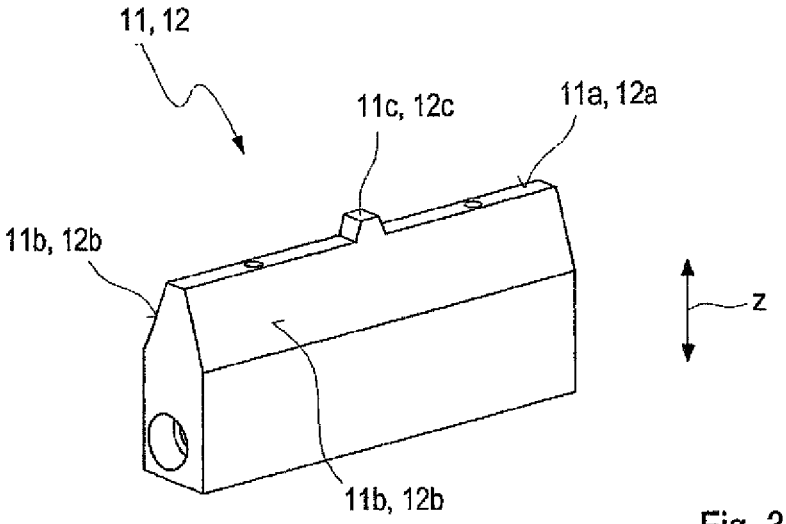
FIG. 3 a schematic and perspective view of a locking wedge with locking nose of the first coupling element according to FIG. 2, FIG. 4 a schematic and perspective view of the second coupling element of the coupling device arranged on the vehicle door according to FIG. 1, which coupling device is used as a vehicle locking device.

Furthermore both locking wedges 11 and 12 have a locking nose 11*c* or 12*c* as shown in FIG. 2; a single locking wedge 11 or 12 is shown in FIG. 3. In the following this locking nose 11*c* or 12*c* is arranged perpendicular central on the side edge 11*a* or 12*a* and therefore extends in vertical direction of the vehicle (z-direction).

The locking wedge holder 13 of the first coupling element 10 is arranged on the front side 3*b* of the vehicle door 2 according to FIG. 1. Within the vehicle door 2 a motor drive device 30 and connection means (not shown in figures) generating an operative connection between the locking wedges 11 and 12 and the motor drive device. This drive device 30 is connected via its housing to the door-stiffening-element 5.

Figure 4:
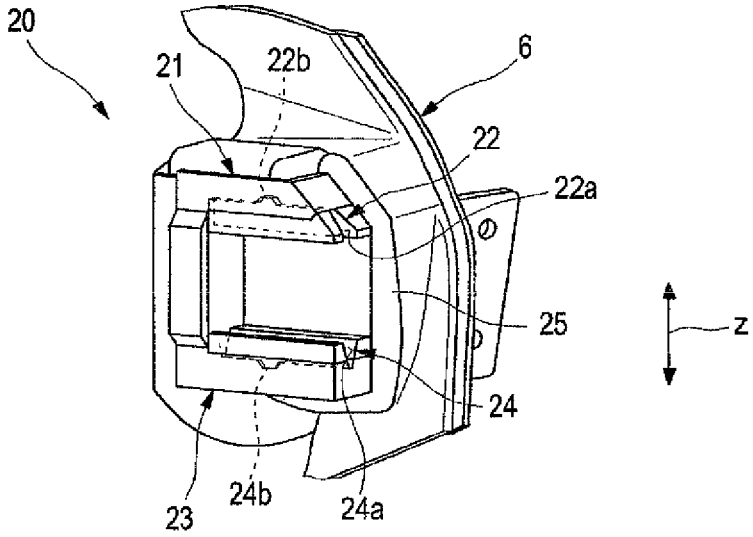

The second coupling element 20 of the vehicle locking apparatus 1 according to FIG. 4 includes two retaining jaws 21 and 23 that are arranged at a distance from one another on a base plate 25, and that receive the locking wedge holder 13 with the two locking wedges 11 and 12 between them as shown in FIG. 1. This second coupling element 20 is mounted to a B-pillar 6 of the vehicle 40, as schematically shown in FIG. 4, so that when closing the vehicle door 2 the locking wedge holder 13 becomes located according to FIG. 1 between the two retaining jaws 21 and 23 with both locking wedges 11 and 12 where it is locked or coupled with the second coupling element 21 and 23. For this purpose, both retaining jaws 21 and 23 each have a respective wedge groove 22 or 24 with wedge-shaped surfaces 22*a* or 24*a*, into which the locking wedges 11 and 12 are pushed by the driving device 30 through movement out of the grooves 13*a* of the locking wedge holder 13 in order to couple and lock both coupling elements 10 and 20.

Simultaneous with such a coupling- and locking process, the locking noses 11 c and 12*c* of the two locking wedges 11 and 12 also engage in to a locking opening 22*b* and 24*b* of the wedge grooves 22 and 24 of the retaining jaws 21 and 23, wherein these locking openings 22*b* and 24*b* are adjusted for form fitting engagement with the locking noses 11*c* and 12*c* in order to achieve a form fit in y-direction of the vehicle 40, i.e., both toward the inside as well as toward the outside.

It is also possible to provide only one of the two locking wedges 11 or 12 with such a locking nose 11*c* or 12*c*, without limiting the vehicle locking function.

Figure 6:
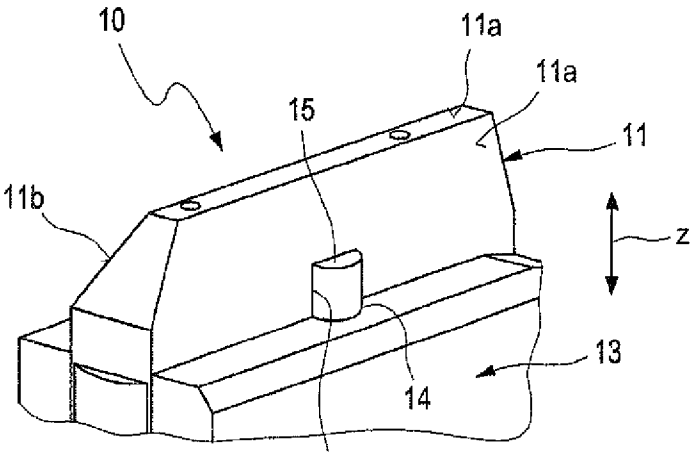
Figure 5:
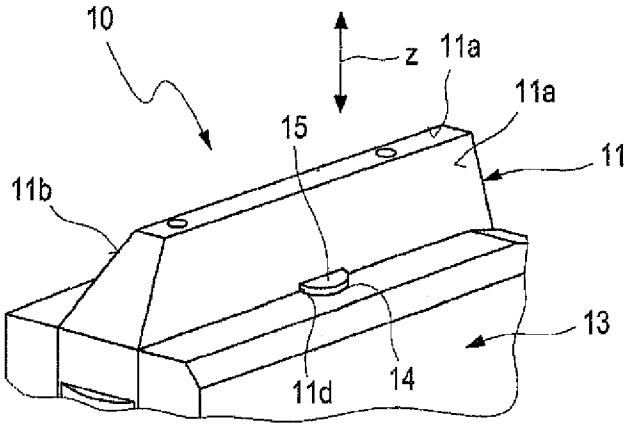
FIG. 5 schematic and perspective partial view of a first coupling element with engaged locking wedge in an alternative embodiment of the locking nose, FIG. 6 a perspective view of the locking wedge holder according to FIG. 5 with disengaged locking wedge and disengaged locking nose, and FIG. 7 a detailed view of a locking wedge holder according to FIG. 6, in the coupled position with a retaining jaw.
Figure 7:
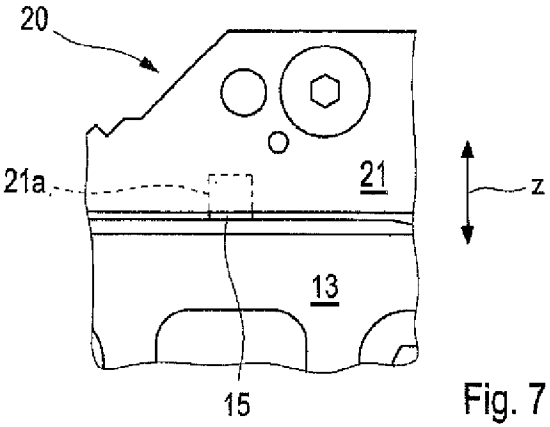

FIGS. 5, 6 and 7 show an alternative embodiment of a locking nose.

For guiding the locking wedges 11 and 12 within the locking wedge holder 13, semicircular grooves 14 that respectively correspond with each other are provided on the locking wedge holder 13 and semicircular grooves lid on the locking wedge 11, so that the hollow cylinders generated thereby can each receive a locking wedge guiding element 15, which is used as locking nose 15. A corresponding embodiment is provided on the opposite retaining jaw 12.

According to FIG. 5 the semicircular groove 11*d* of the locking wedge 11 and the length of the locking wedge guiding element 15 may be adjusted to each other so that in the state of being received in the locking wedge holder 13, the upper front side of the locking wedge guiding element 15 aligns frontally with the locking wedge holder 13. Along with the extension the locking wedge 11 or respectively the movement of the locking wedge 11 into the wedge groove 22 of the retaining jaw 21, the locking wedge guiding element as locking nose 15 correspondingly also extends according to FIG. 6 and as shown schematically in FIG. 7 moves into a semicircle groove 21*a* of the retaining jaw 21 of the second coupling element 20, which semicircle groove 21*a* is adjusted to the locking wedge guiding element 15.

According to FIG. 1 a closing aid 7 including a closing hook may be provided in the lower area of the vehicle door 2 on the lock-side front side 3*b* of the vehicle door, which closing hook engages into a bracket situated at the opposite B-pillar 6. Such a bracket can also be arranged at the sill or can be designed as body-in-white bracket.

What is claimed is:

1. A vehicle locking device for releasably connecting a vehicle door to a structural part of the vehicle, said vehicle locking device comprising:

a coupling device, said coupling device comprising:

a first coupling element connected to one of the vehicle door or structural part of the vehicle, said first coupling element comprising two locking wedges, said locking wedges each having wedge faces, at least one of said locking wedges being provided with a locking nose;

a second coupling element connected to the other one of the vehicle door or the structural part of the vehicle, said second coupling element comprising two retaining jaws and interacting with the first coupling element, said two retaining jaws having wedge grooves that have wedge faces, said first coupling element being received between the two retaining jaws; and a drive device connected to the first coupling element for 1) moving the locking wedges apart from each other thereby pushing the locking wedges into the wedge grooves, wherein the locking nose is received in a locking opening arranged within one of the retaining jaws or 2) moving the locking wedges toward each other thereby moving the locking wedges away from the wedge grooves, wherein the locking nose is moved away from the locking opening arranged within one of the retaining jaws.

2. The locking apparatus of claim 1, wherein the locking nose is provided on a front side of the at least one of the locking wedges and the locking opening is arranged within a wedge groove of the one of the two retaining jaws.

3. The locking apparatus of claim 1, wherein the locking nose is constructed as a locking wedge guiding element which is guided in a vertical direction of the motor vehicle in a half groove formed by the locking wedge and the retaining jaw, and is moved during the moving apart of the locking wedges from a retracted position into the locking opening of the retaining jaw.

4. The vehicle locking apparatus of claim 1, wherein the vehicle structure is a vehicle body pillar.

5. The vehicle locking apparatus of claim 1, wherein the vehicle structure is a B-pillar.

6. The vehicle locking apparatus of claim 1, wherein the vehicle door is configured as a U-section.

* * * * *